US011998126B2

(12) United States Patent
Trammel

(10) Patent No.: US 11,998,126 B2
(45) Date of Patent: Jun. 4, 2024

(54) DISH STACKER AND HOLDER, SYSTEMS AND METHODS

(71) Applicant: Sandra Trammel, Morris, IL (US)

(72) Inventor: Sandra Trammel, Morris, IL (US)

( * ) Notice: Subject to any disclaimer, the term of this patent is extended or adjusted under 35 U.S.C. 154(b) by 23 days.

(21) Appl. No.: 17/887,607

(22) Filed: Aug. 15, 2022

(65) Prior Publication Data

US 2023/0061832 A1 Mar. 2, 2023

Related U.S. Application Data

(60) Provisional application No. 63/238,974, filed on Aug. 31, 2021.

(51) Int. Cl.

| | |
|---|---|
| ***A47G 19/08*** | (2006.01) |
| ***A47G 19/00*** | (2006.01) |
| ***A47G 19/23*** | (2006.01) |

(52) U.S. Cl.

CPC ..... *A47G 19/08* (2013.01); *A47G 19/00* (2013.01); *A47G 19/23* (2013.01)

(58) Field of Classification Search

CPC ..... A47J 47/16; A47J 36/34; A47G 19/08; A47G 23/0616; A47G 7/041; A47G 19/00; A47G 19/02; A47G 19/23; B65D 21/0209; B65D 21/0212; B65D 21/0215; B65D 21/0224

USPC ..... 248/146

See application file for complete search history.

(56) References Cited

U.S. PATENT DOCUMENTS

| | | | | |
|---|---|---|---|---|
| 419,169 A * | 1/1890 | Herrick et al. | .... | A47G 29/1216 248/146 |
| 779,924 A * | 1/1905 | Gommel | ..... | B65D 85/505 48/2 |
| 837,388 A * | 12/1906 | Curial | ..... | A47J 36/022 248/167 |
| 1,342,807 A * | 6/1920 | Harrington | ..... | D06F 1/06 220/4.12 |

(Continued)

FOREIGN PATENT DOCUMENTS

| | | | | |
|---|---|---|---|---|
| CH | 685595 A5 * | 8/1995 | ..... | A47G 19/08 |
| CN | 202820641 | 3/2013 | | |

(Continued)

OTHER PUBLICATIONS

Unknown, Corning Museum of Glass, Pyrex Chip and Tip in "Turquoise" Pattern, Unknown Date (Prior To Jul. 21, 2021), Retrieved from https://www.cmog.org/artwork/pyrex-chip-and-dip on Jul. 21, 2021.

(Continued)

*Primary Examiner* — Taylor Morris

(74) *Attorney, Agent, or Firm* — The Law Offices of Konrad Sherinian, LLC; Jeffrey S. Dixon

(57) ABSTRACT

An innovative dish stacker and holder. The dish stacker and holder includes a ring and legs connected to the ring, the legs extending downwardly from the ring. The legs are operative to stand flush on a floor surface of a dish below the stacker and holder, and the ring is operative to receive a downwardly extending base of a dish above the stacker. A ledge connected to ring extends below and overlaps a portion of an area circumscribed by the ring. The ledge is operative to engage and support a bottom side of a dish base inserted through an opening in the area circumscribed by the ring.

12 Claims, 7 Drawing Sheets

(56) References Cited

U.S. PATENT DOCUMENTS

| | | | | | |
|---|---|---|---|---|---|
| 1,383,779 | A * | 7/1921 | Workman | A47J 36/34 | 206/514 |
| 1,495,991 | A * | 6/1924 | Drynan | A47J 36/34 | 248/172 |
| 1,514,313 | A * | 11/1924 | Davenport | A47J 47/16 | 248/167 |
| 1,759,645 | A | 5/1930 | Janke | | |
| 1,980,131 | A * | 11/1934 | Flanagan | A47J 36/34 | 215/396 |
| 3,094,258 | A * | 6/1963 | Punke | A47J 45/10 | 294/142 |
| 3,100,459 | A * | 8/1963 | Liss | A47B 7/02 | 297/239 |
| 3,751,852 | A * | 8/1973 | Schrepper | A01G 9/028 | 47/87 |
| 4,032,097 | A * | 6/1977 | Dwyer | A47J 36/34 | 211/85.18 |
| 4,279,354 | A * | 7/1981 | Conti | B65D 1/36 | 220/555 |
| 4,319,727 | A * | 3/1982 | Rattay | A47G 7/041 | 248/172 |
| 5,404,800 | A * | 4/1995 | Hsu | A47J 36/34 | 220/759 |
| 5,467,697 | A * | 11/1995 | Hunziker | A47J 36/24 | 99/449 |
| 5,590,861 | A * | 1/1997 | Ardolino | A47G 23/0216 | 248/154 |
| 5,762,195 | A * | 6/1998 | Stevens | A47G 19/23 | 206/499 |
| 6,374,755 | B1 * | 4/2002 | Haase | A21C 15/00 | 108/158 |
| 6,578,802 | B1 * | 6/2003 | Thier | B67D 3/0029 | 248/146 |
| 7,137,509 | B1 * | 11/2006 | Burns | A47G 19/23 | 206/516 |
| 8,123,049 | B2 * | 2/2012 | Shen | A47J 47/16 | 211/41.11 |
| 8,840,073 | B2 * | 9/2014 | Sakairi | F16M 11/00 | 220/629 |
| 9,420,914 | B2 * | 8/2016 | Hamlin | A47J 36/34 | |
| 9,718,582 | B2 * | 8/2017 | Hylton | A47G 21/18 | |
| 10,051,983 | B2 * | 8/2018 | Peterson | A47G 19/02 | |
| 11,111,056 | B2 * | 9/2021 | Chisholm | B65D 21/0233 | |
| 2005/0077695 | A1 * | 4/2005 | Sherer | B25H 3/02 | 280/79.5 |
| 2006/0032776 | A1 * | 2/2006 | Klein | B65D 1/265 | 206/520 |
| 2009/0057248 | A1 * | 3/2009 | Vishnevsky | B65D 21/0224 | 211/74 |
| 2009/0206046 | A1 * | 8/2009 | Lunato | A01G 9/02 | 211/85.18 |
| 2011/0232184 | A1 * | 9/2011 | Fagan | A47G 7/041 | 47/66.7 |
| 2013/0068806 | A1 | 3/2013 | Bayles | | |
| 2015/0090726 | A1 * | 4/2015 | Reichel | A47G 19/02 | 220/575 |
| 2018/0132665 | A1 | 5/2018 | Brown | | |
| 2020/0205592 | A1 | 7/2020 | Fried | | |
| 2021/0120986 | A1 * | 4/2021 | Carder | A47G 19/02 | |
| 2021/0269194 | A1 * | 9/2021 | Barber | A47J 37/108 | |
| 2023/0049985 | A1 * | 2/2023 | Du | A47G 23/08 | |

FOREIGN PATENT DOCUMENTS

| | | | | | |
|---|---|---|---|---|---|
| CN | 202941799 | U | | 5/2013 | |
| CN | 106820841 | A | * | 6/2017 | A47G 19/08 |
| DE | 2456768 | A1 | | 6/1975 | |
| EP | 2134220 | B1 | | 12/2009 | |
| FR | 2634364 | A1 | * | 1/1990 | A47G 19/08 |
| KR | 200198776 | Y1 | * | 10/2000 | A47G 19/00 |
| KR | 20110000786 | U | * | 1/2011 | A47G 19/23 |
| KR | 20140001332 | U | * | 3/2014 | A47G 19/23 |
| NL | 2001236 | C2 | | 8/2009 | |
| TW | M565534 | U | | 8/2018 | |

OTHER PUBLICATIONS

Unknown, Uzo Glass Bowl with Stand, Unknown Date (Prior To Jul. 21, 2021), Retrieved from https://www.nicobar.com/products/uzo-glass-bowl-with-stand on Jul. 21, 2021.

* cited by examiner

DISH STACKER AND HOLDER, SYSTEMS AND METHODS

CROSS-REFERENCE

This application claims the priority benefit of U.S. provisional application No. 63/238,974, entitled DISH STACKER AND HOLDER, SYSTEMS AND METHODS, filed Aug. 31, 2021, which is incorporated by reference herein in its entirety for all purposes.

FIELD OF THE DISCLOSURE

The present disclosure relates to a dish stacker and holder stand. More particularly, it relates to a dish stacker and holder stand that stands freely when placed on a lower dish while stably supporting an upper dish placed on the stand.

BACKGROUND

It is often desired to stack two or more dishes on one another in a vertically spaced apart arrangement, such as to create a pleasing and space-efficient presentation of appetizers, sauces, or the like for guests to help themselves. However, with existing apparatus and methods, such dish stacks are unstable, the dishes and/or stacking apparatus easily toppling or spilling when carried or moderately jostled. A need therefore exists for an apparatus that produces a stable vertical stack of spaced apart dishes.

BRIEF DESCRIPTION OF THE DRAWINGS

Although the characteristic features of this disclosure will be particularly pointed out in the claims, the disclosed method and system, and how it may be made and used, may be better understood by referring to the following description taken in connection with the accompanying drawings forming a part hereof, wherein like reference numerals refer to like parts throughout the several views and in which:

A person of ordinary skill in the art will appreciate that elements of the figures above are illustrated for simplicity and clarity and are not necessarily drawn to scale. The dimensions of some elements in the figures may have been exaggerated relative to other elements to help to understand the present teachings. Furthermore, a particular order in which certain elements, parts, components, modules, steps, actions, events and/or processes are described or illustrated may not be required. A person of ordinary skill in the art will appreciate that, for simplicity and clarity of illustration, some commonly known and well-understood elements that are useful and/or necessary in a commercially feasible embodiment may not be depicted to provide a clear view of various embodiments per the present teachings.

DETAILED DESCRIPTION

In the following description of various examples of embodiments of the disclosed system and method, reference is made to the accompanying drawings, which form a part hereof, and in which are shown by way of illustration various example devices, systems, and environments in which aspects of the disclosed system and method can be practiced. Other specific arrangements of parts, example devices, systems, and environments, can be used, and structural modifications and functional modifications can be made without departing from the scope of the disclosed system and method.

As illustrated in the accompanying drawings and described herein, the present disclosure provides legged dish stacker and holder stands ("dish stands" or "stands") for supporting and stabilizing a plurality of stacked dishes, and methods of using the dish stands to assemble dishes into a stable stack with vertical clearance above each dish in the stack. In embodiments, sufficient vertical clearance is provided above each dish to facilitate holding and serving foodstuffs from the dish. In embodiments, the stack of dishes is freestanding when the bottom dish is supported on a level surface. In embodiments, when holding the bottom dish level by hand, the stack can easily be carried without the stack collapsing or any dish tipping relative to the bottom dish, and thus without any dish spilling foodstuffs out of the stack or onto a lower dish.

Figure 1:
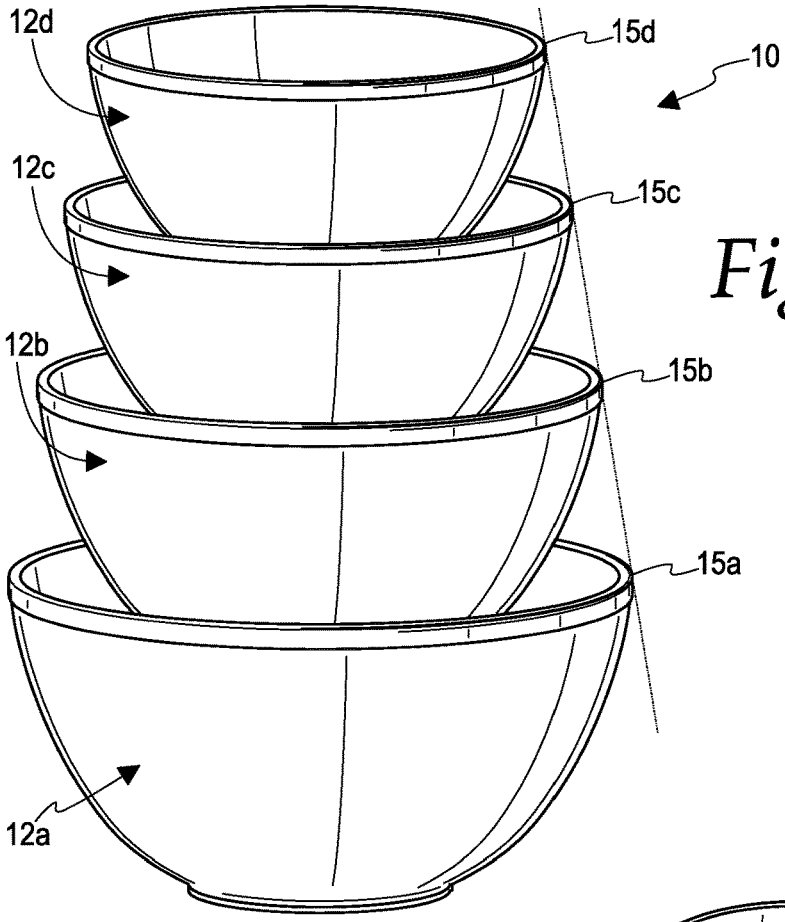
FIG. 1 is a top perspective view of a dish stack according to an embodiment of the disclosure.
Figure 2:
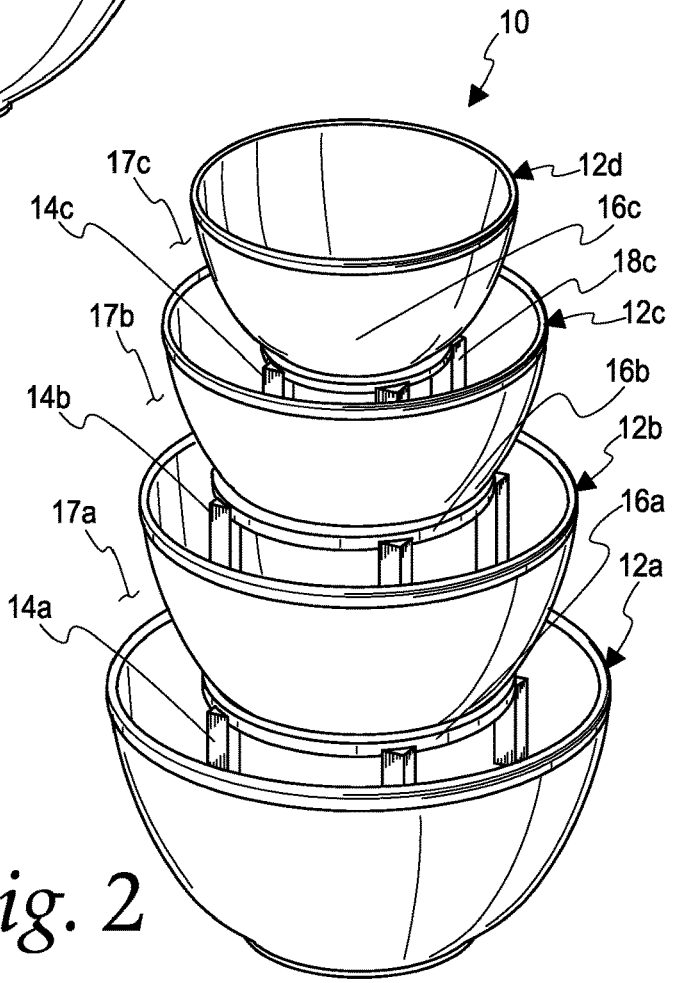
FIG. 2 is a top perspective view of the dish stack of FIG. 1, viewed from a higher angle.

With reference to FIGS. 1-9, a dish stack 10 and its components according to an embodiment are now described. The dish stack 10, as shown in FIGS. 1-2, comprises a plurality of stacked, vertically spaced apart dishes 12*a*, 12*b*, 12*c*, 12*d* and a plurality of dish stacker and holder stands 14*a*, 14*b*, 14*c*. The stands 14*a-c* are placed on the respective dishes 12*a-c*, the dishes 12*b-d* in turn being placed on the stands 14*a-c*, respectively. Each stand 14*a-c* has a corresponding supporting dish 12*a-c* and a corresponding supported dish 12*b-d*. For example, the dish 12*b* acts as both the supported dish of the stand 14*a* and the supporting dish of the stand 14*b*. In the illustrated embodiment, the dishes 12*a-d* are stacked in decreasing order of their relative sizes from the bottom dish 12*a* to the top dish 12*d*. The dishes 12*a-d* are also of a similar circular shape, each being generally axisymmetric about a vertical axis of the respective dish 12*a-d* and aligned generally coaxially in the dish stack 10. In an embodiment, the dishes 12*a-d* and the stands 14*a-c* are provided as a set, the dishes 12*a-d* and the stands 14*a-c* being adapted and configured to be assembled into the dish stack 10. In an embodiment, respective rims of a dish stack in accordance with the disclosure align to define a uniform stack taper angle. That is, a tangent line to a rim 15*a* of the dish 12*a* and a rim 15*d* of the dish 12*d*, in a plane containing a common z-axis of the dishes 12*a-d*, is also tangent, or nearly tangent, to the respective rim 15*b*, 15*c* of each of the dishes 12*b*, 12*c*, as drawn on FIG. 1.

As best seen in FIG. 2, each successive dish 12*b-d* of the dish stack 10 is vertically separated from the preceding dish 12*a-c* by the respectively interposed stand 14*a-c*. This vertical separation produces a gap 17*a-c* between each dish 12*a-c* and the dish 12*b-d* stacked above it. In embodiments, each gap 17*a-c* is sized and shaped to permit an average adult to easily serve oneself from the dish 12*a-c* through the gap 17*a-c*, such as by inserting a utensil or a thumb and forefinger through the gap 17*a-c* to retrieve a food item or substance. For example, the dish stack 10 may be suitable for presenting and serving such foodstuffs as nuts, fruits, candies, skewers, crackers, charcuterie or other appetizers, and/or dips and sauces. Contents of one of the dishes 12*a-d* may complement those of another dish. For example, fruits may be presented in dishes 12*a-c* for dipping in a chocolate sauce presented in the dish 12*d*.

Figure 3:
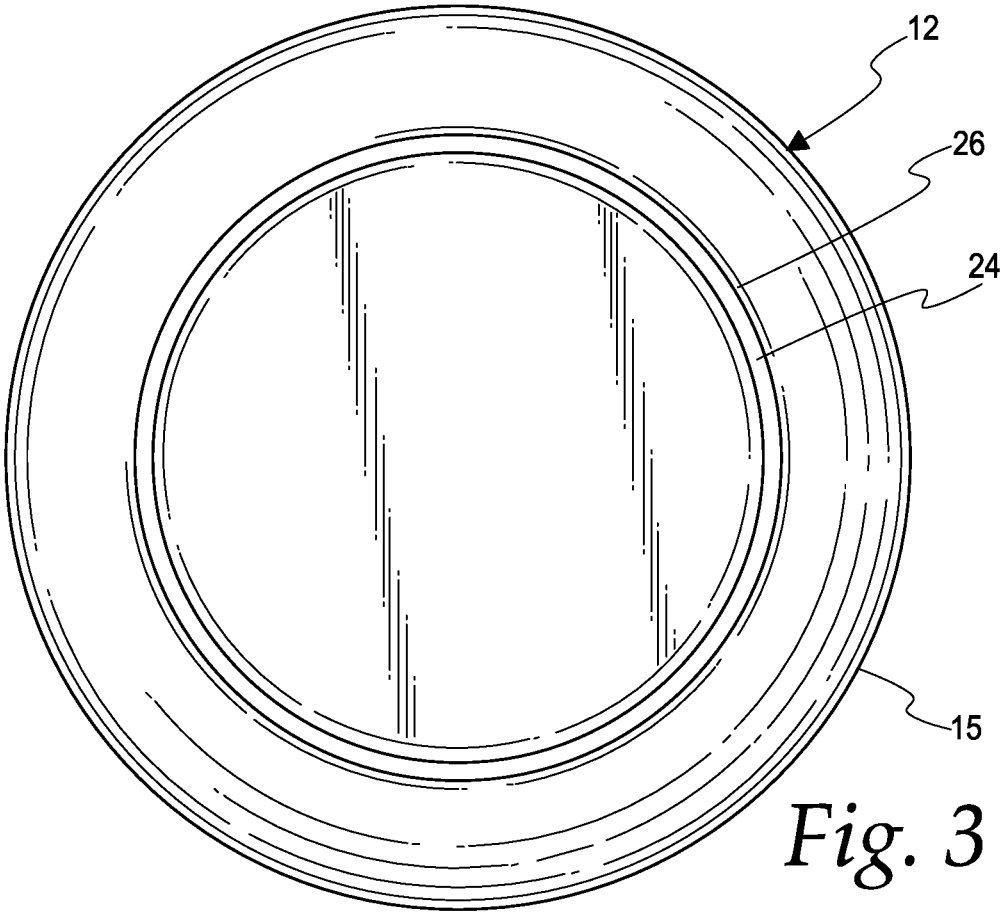
FIG. 3 is a bottom plan view of a dish for use in a dish stack according to an embodiment of the disclosure.
Figure 4:
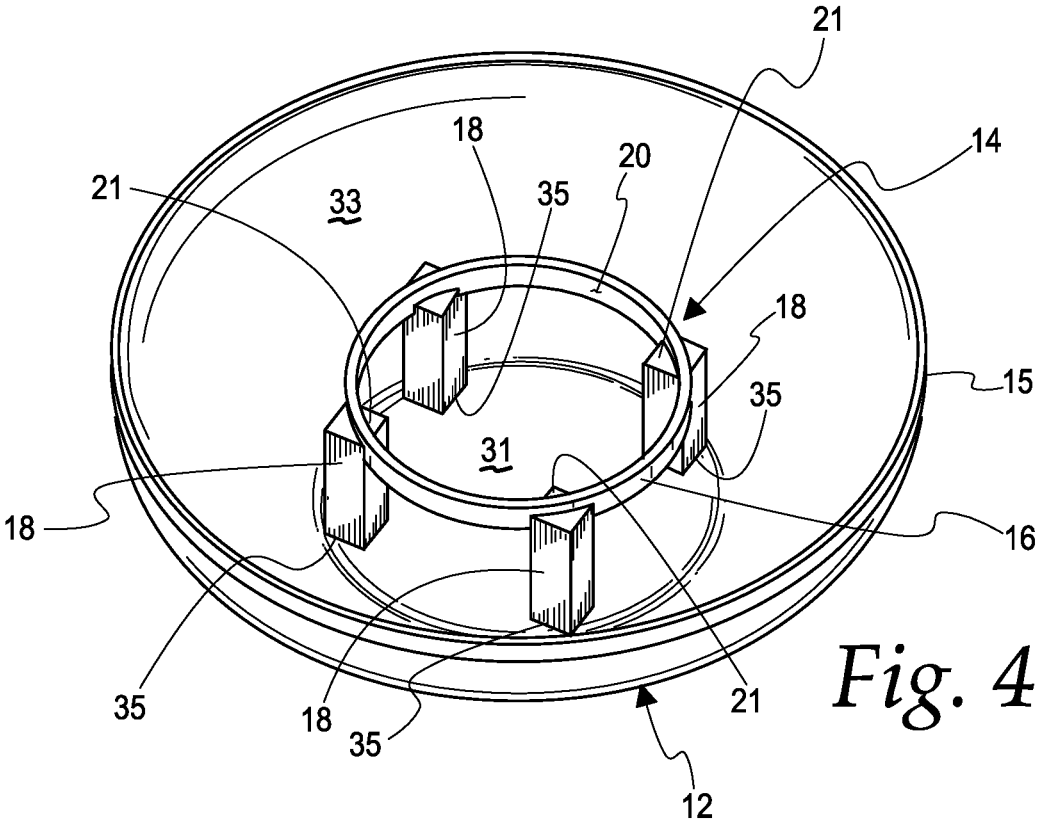
FIG. 4 is a top perspective view of a dish holder for use in a dish stack stacked on a dish for use in a dish stack, according to an embodiment.
Figure 5:
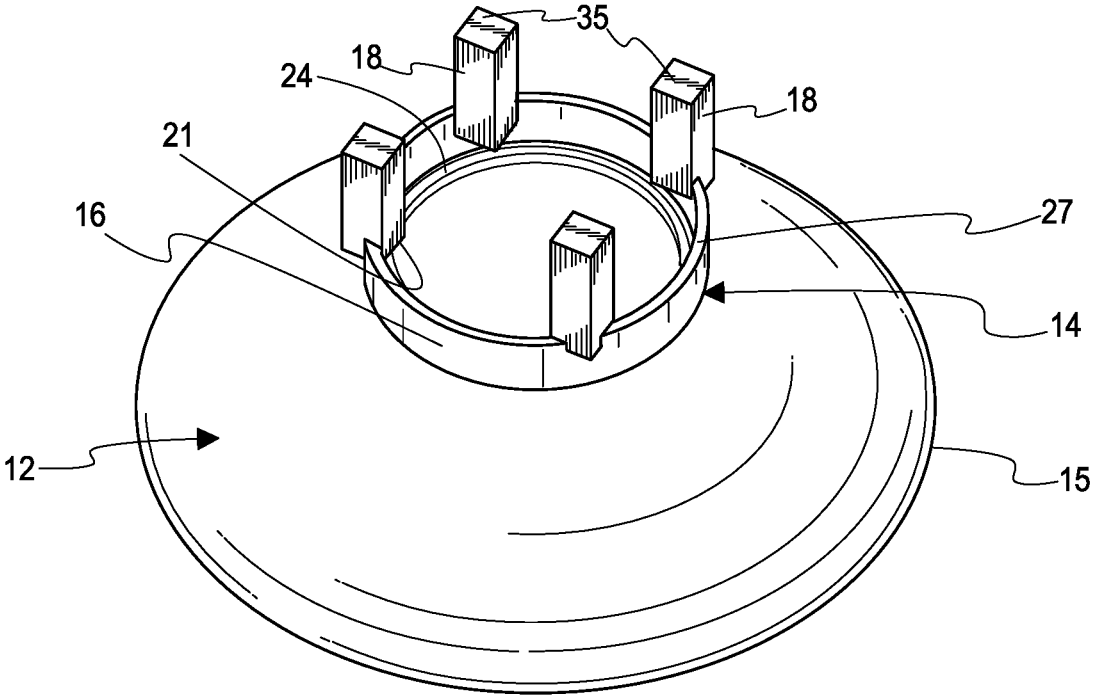
FIG. 5 is a bottom perspective view of a dish for use in a dish stack stacked on a dish holder for use in a dish stack, according to an embodiment.
Figure 6:
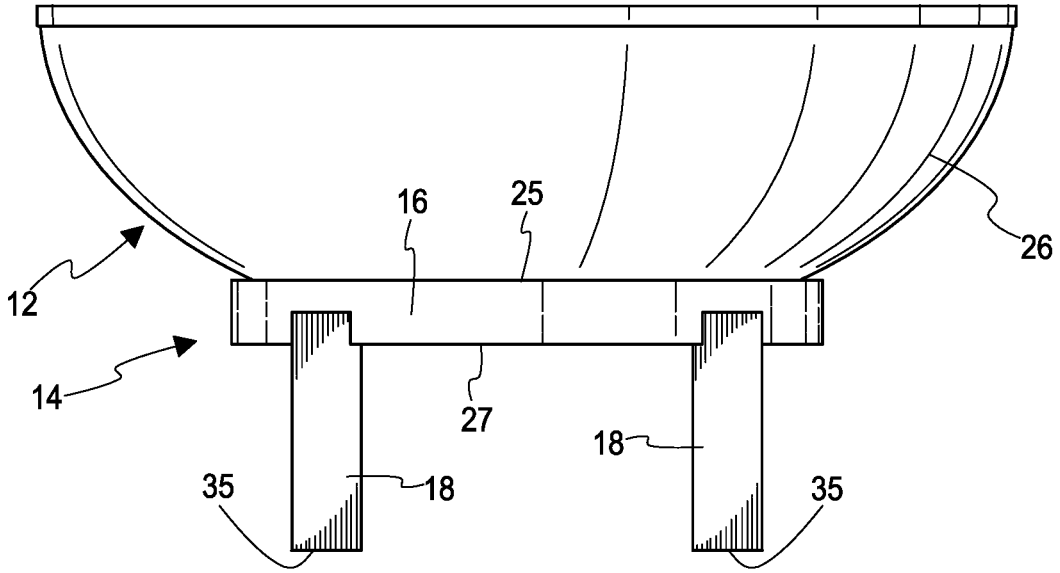
FIG. 6 is a side view of the dish stacked on a dish holder of FIG. 5.
Figure 7:
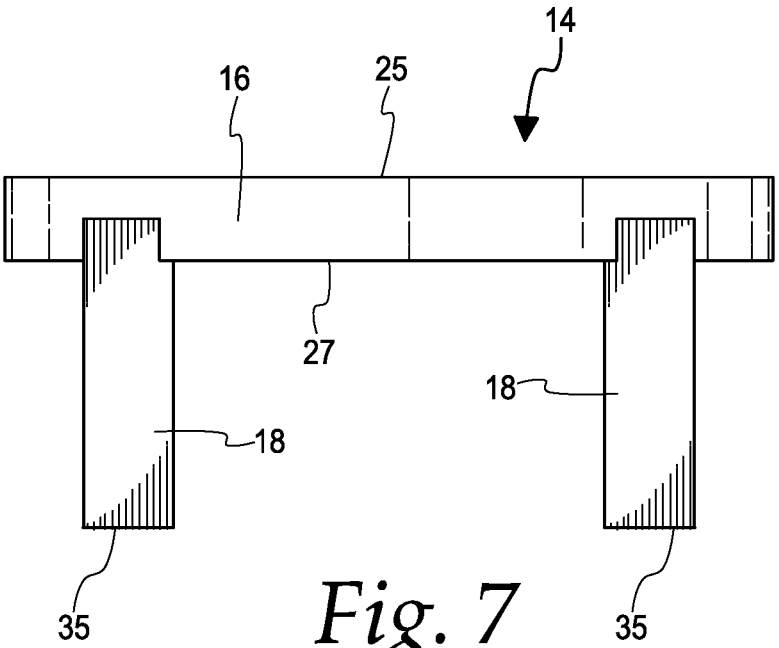
FIG. 7 is a side elevation view of a dish holder for use in a dish stack according to an embodiment of the disclosure.
Figure 8:
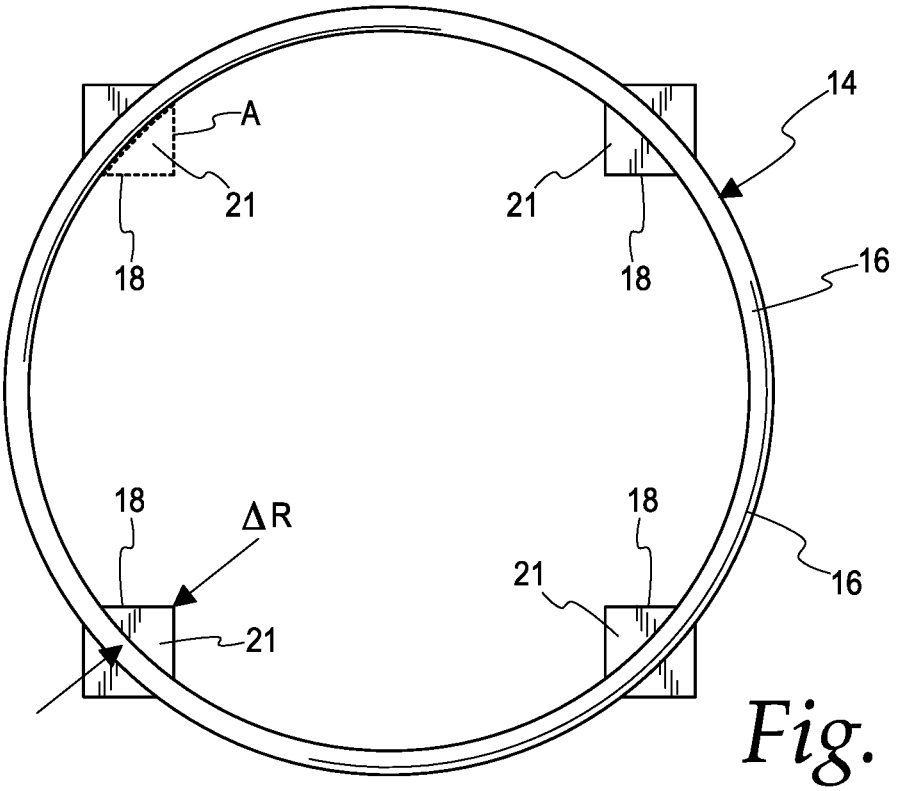
FIG. 8 is a top plan view of the dish holder of FIG. 7.

With reference to FIGS. 3-8, a dish 12 and a stand 14 for use in forming a dish stack according to an embodiment are illustrated. The dish 12 is shown separately in FIG. 3, the stand 14 is shown separately in FIGS. 7 and 8, the stand 14 stacked on a dish 12 sized to receive the stand 14 according to a method is shown in FIG. 4, and another dish 12 sized to be received by the stand 14, stacked on the stand 14 according to a method, is shown in FIGS. 5 and 6. Each dish 12*a-d* and each stand 14*a-c* of the dish stack 10 comprises analogous features to those of the dish 12 shown in each of FIGS. 3-6 and the stand 14 as shown in each of FIGS. 4-8, as described here, the features being adapted to permit the respective stand 14*a-c* to fit between a respective consecutively stacked pair of the dishes 12*a-d*.

As best seen in FIGS. 4-8, the stand 14 comprises a ring 16 and four elongate, generally vertical legs 18 joined to the ring 16 and extending downwardly therefrom. The ring 16 surrounds an opening 20 for receiving an inserted portion of a bottom side of a specific dish, or that of a dish of a particular type and/or size. In addition, the legs 18 are connected to the ring 16 so that a ledge 21 formed at an upper end of each leg 18 overlaps the opening 20, the ledges 21 generally lying in a common horizontal plane below a top side 25 of the ring 16. In embodiments including the illustrated embodiment, the common horizontal plane of the ledges 21 is above a bottom side 27 of the ring 16. In an, each ledge 21 overlaps a planar area A comprised in the opening 20, the planar area A being equal to at least 30% of a cross-sectional area of the corresponding leg 18. In another embodiment, each ledge 21 radially overlaps the opening 20 by a radial intrusion distance Δr, the radial intrusion distance Δr being equal to at least 15% of a diameter $D_i$ of the opening 20.

It should be noted that a ring of a holder according to embodiments of this disclosure can be circular, rectangular, oval, or any desired shape, which will typically be symmetrical, to fit the corresponding supported dish. In particular, the ring is adapted to fit closely around a perimeter of an inserted portion of the bottom side of the supported dish, so as to prevent or limit lateral movement of the supported dish. More particularly, the dish stand is operative to receive the inserted portion of the supported dish so that a bottom side of the inserted portion is in contact with the ledges and supported thereon. Still more particularly, when the inserted portion of the supported dish is supported on the ledges, a lateral clearance, if any, between the ring and the perimeter of the inserted dish portion is small enough that the ring obstructs the inserted dish portion from sliding off of any of the ledges in a horizontal direction. Still more particularly, the ring is operative to fit the perimeter of the of the inserted dish portion so as to retain the supported dish in a horizontal position relative to the ring, for example by conforming to the entire perimeter of the inserted dish portion, or by touching three evenly spaced points on the perimeter of an inserted dish portion that is circular or round. More particularly, the ring and the supported dish can corresponding axes, and the retained position of the supported dish may be coaxial relative to the ring. The inserted portion of the supported dish can be a table-contacting base portion, such as is commonly formed as a downward projection having an area smaller than and generally centered within an outer perimeter of the dish, the dish outer perimeter typically being disposed at a rim of the dish.

As shown in FIG. 3, the dish 12 has a bottom side including a base 24. The opening 20 of the stand 14 being operative to receive the base 24 of the dish 12, as best seen in FIG. 5. The opening 20 and a bottom perimeter of the base 24 are both generally circular, the diameter of the opening 20 being approximately equal to that of the bottom perimeter of the base 24. In other embodiments, the opening and the base bottom perimeter are each of another shape, the shape of the opening being substantially congruent to that of the base bottom perimeter.

Turning to FIG. 4, a top side of the dish 12 includes a generally flat, horizontal dish floor surface 31 and an upturned dish inner sidewall surface 33. In the illustrated embodiment, the dish inner sidewall surface 33 is generally axisymmetric about the vertical axis of the dish 12. Preferably, to promote stability and resist tipping of the stand 14 stacked on the supporting dish 12, the legs 18 of the stand 14 have generally flat, coplanar lower ends 35, the leg lower ends 35 being adapted and configured to be placed simultaneously flush on the floor surface 31, each lower end 35 lying within an area of the dish floor surface 31, which is bounded by a perimeter of the dish floor surface 31 where the dish floor surface 31 is joined to the dish inner sidewall surface 33. In embodiments including the illustrated embodiment, the lower ends 35 fit closely within the perimeter of the dish floor surface 31, so that the sidewall surface 33 helps to align the stand 14, and thus to align a supported dish 12 stacked on the stand 14 in a desired orientation relative to the supporting dish 12 below it, such as the generally concentric, coaxial orientation illustrated in the drawings. This close fit also allows the sidewall surface 33 to obstruct lateral movement of the legs 18 so as to prevent or limit sliding of the stand 14 within the area of the dish floor surface 31, thus promoting the stability of the dish stack 10.

Figure 9:
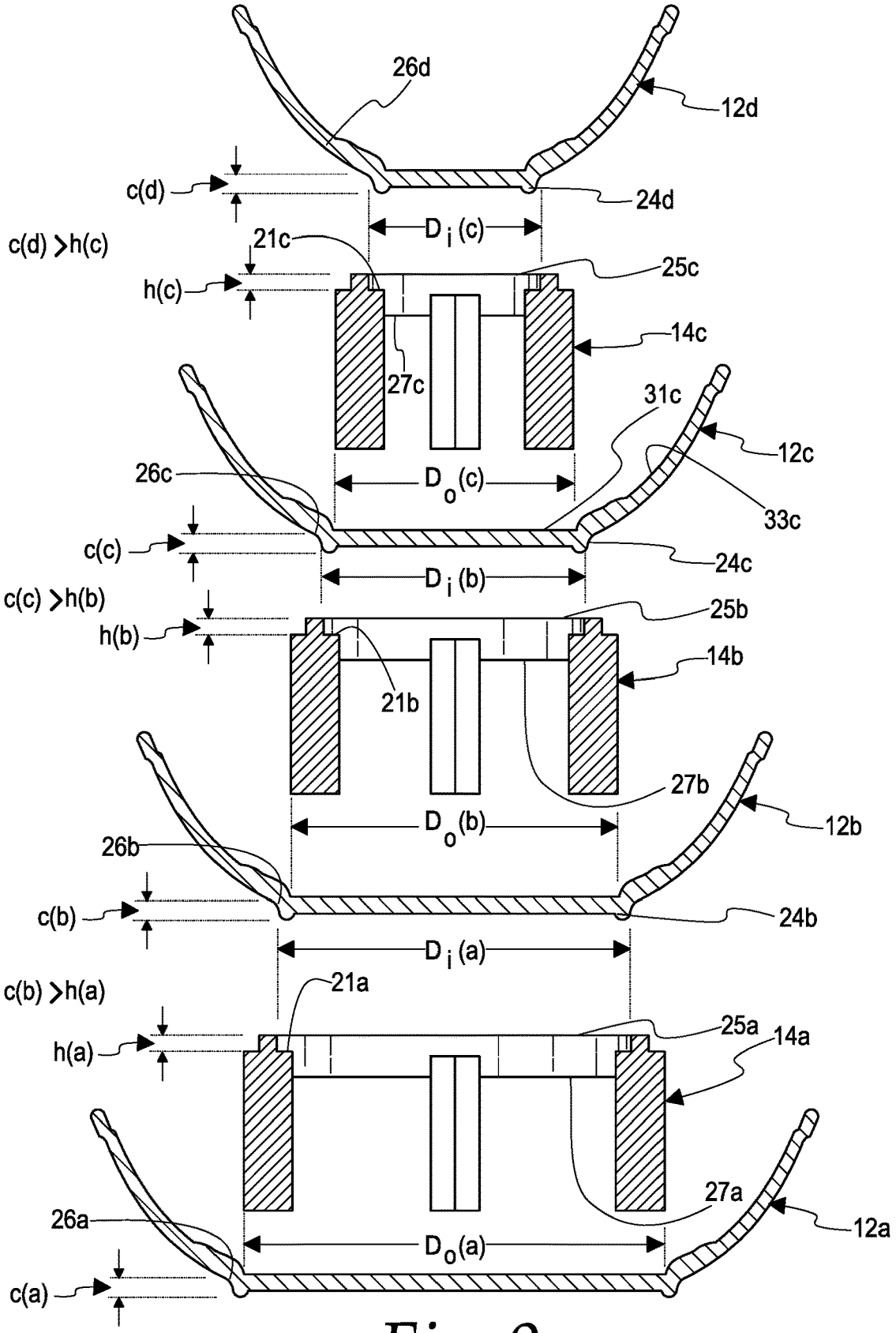
FIG. 9 is an exploded cross-sectional side elevation view of the dish stack of FIG. 1.
Figure 10:
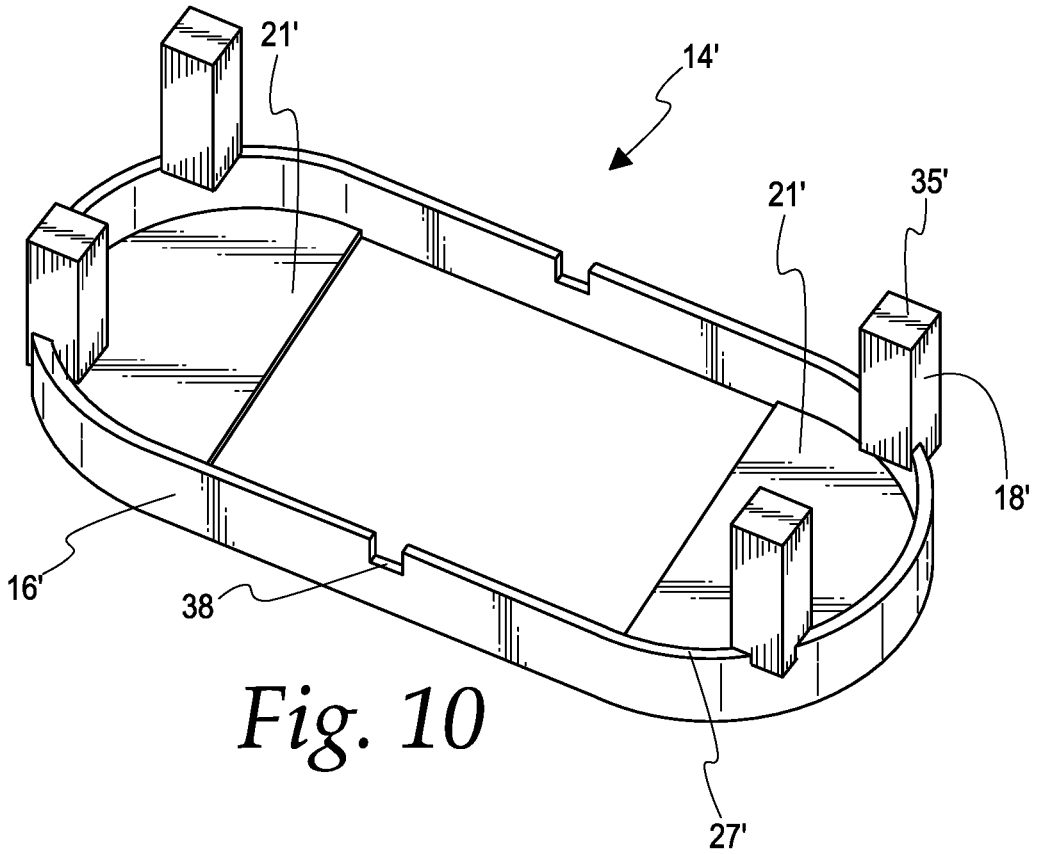
FIG. 10 is a bottom perspective view of another dish holder according to an embodiment of the disclosure.
Figure 11:
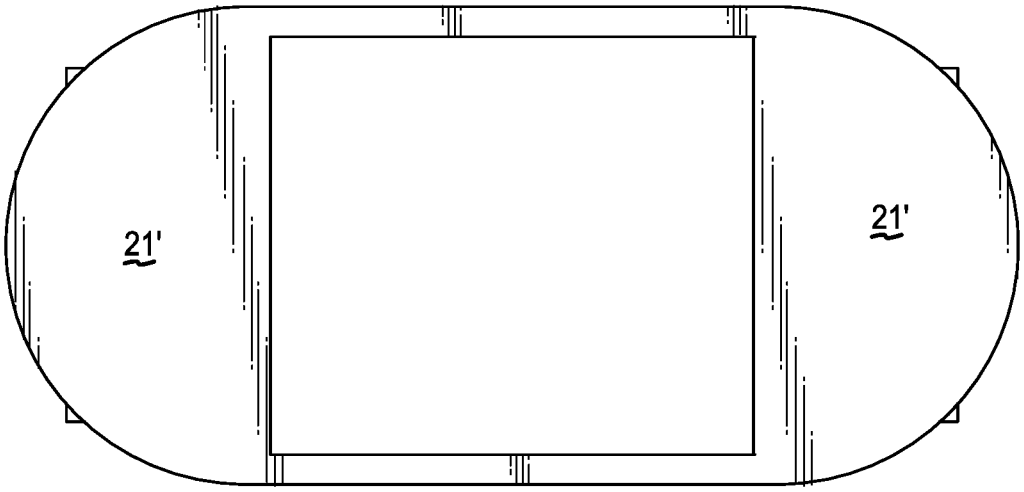
FIG. 11 is a top plan view of the dish holder of FIG. 10.

With reference to FIG. 9, which is an exploded, cross-sectional side elevation view of the entire dish stack 10 shown in FIGS. 1 and 2, each dish 12*b-d* has a base clearance height c(b)-c(d) between a bottom perimeter of the base 24*b-d* and a point 26*b-d* on an overhanging portion of the bottom side of the dish 12*b-d* disposed vertically above the bottom perimeter of the base 24*b-d*, at which point 26*b-d* the bottom side of the dish 12*b-d* begins to extend radially outwardly beyond the perimeter of the base 24. In embodiments of the stand 14*a-c*, a height h(a)-h(c) of a portion of the ring 16*a-c* that extends from the ledges 21*a-c* to a top end of the ring 16*a-c* is less than or equal to the base clearance height c(b)-c(d) of the dish 12*b-d*, so as to permit the base 24 to be inserted axially through the opening 20 and into contact with the ledges 21 to be supported thereon. This allows the ledges 21 to resist tipping of the dish 12 by obstructing points on the base 24 from moving downward below the plane of the ledges 21.

In embodiments, a holder includes a ring with one or more cutouts on its bottom side. For example, notches on the bottom side of the ring can allow a holder to fit over the features of certain specialized dishes, such as those that have dividers.

Figure 12:
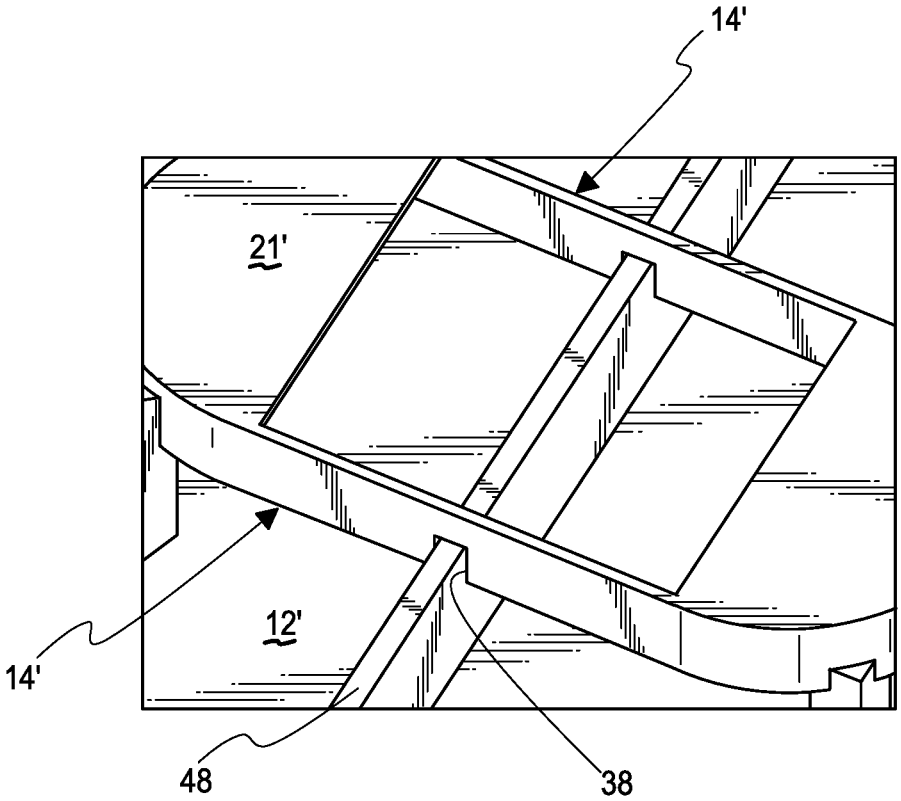
FIG. 12 is a truncated top perspective view of the dish holder of FIG. 10 stacked in a dish with a divider, according to an embodiment of the disclosure.
Figure 13:
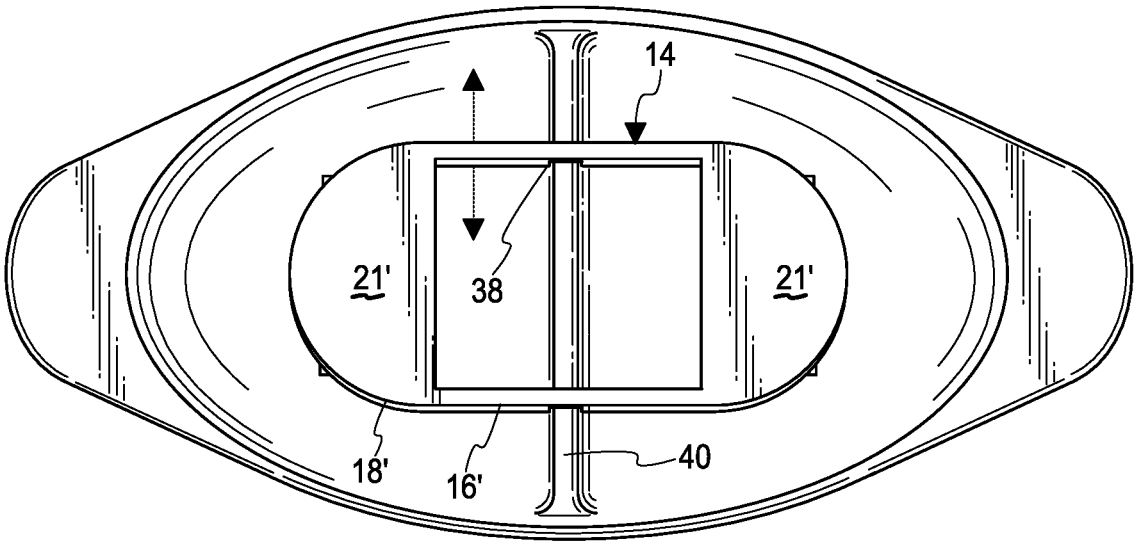
FIG. 13 is a top plan view of the dish holder stacked in a dish of FIG. 12.

Thus, with reference to FIGS. 10-13, a specialized dish stacker-stand 14' includes a ring 16', a plurality of legs 18' (more particularly, four legs 18') connected to and extending downwardly from the ring 16', the ring 16' having notches 38 formed in a bottom side 27' of the ring 16'. The notches 38 are operative to receive a divider 40 of a specialized dish 12' on which the specialized stand 14' is stacked, as shown in FIGS. 12 and 13. In this illustrated embodiment, when the stand 14' is stacked on the dish 12', there is lateral clearance between at least one pair of the legs 18' and a dish inner sidewall surface 33' of the dish 12', so as to allow the stand 14' to be oriented generally concentrically over the dish 12', or moved closer to one or the other of its longer sides, as indicated by the dashed arrows in FIG. 13, while remaining centered with respect to its major diameter (that is, centered about the divider 14'). Thus, two different types of chips, crackers, or vegetables may be presented in the dish 12' on either side of the divider 40, while the above dish may hold a salsa, dip, or spread, the dish above optionally being divided like the dish 12' below, so as to hold one, two, or even more salsas, dips, and/or spreads. The stand 14' includes ledges 21', each of which spans an entire minor diameter of the ring 16'. In the illustrated embodiment, in contrast to the structure of the stand 14 described above, no part of the ring 16' extends above the ledges 21'. The stand 14' instead takes advantage of greater traction provided by the ledges 21', which cover a greater portion of an inner perimeter of and area circumscribed by the ring 16' than do their counterparts, the ledges 21, of those of the corresponding ring 16, to stabilize a dish placed thereon against lateral sliding. In other embodiments (not shown), a holder otherwise similar to the stand 14' includes a portion of a ring that extends above a ledge provided for supporting the bottom side of a dish base, so as to provide additional stability by directly obstructing a path of lateral movement of the dish base.

The preceding description of the disclosure has been presented for purposes of illustration and description and is not intended to be exhaustive or to limit the disclosure to the precise form disclosed. The description was selected to best explain the principles of the present teachings and practical application of these principles to enable others skilled in the art to best utilize the disclosure in various embodiments and various modifications as are suited to the particular use contemplated. It should be recognized that the words "a" or "an" are intended to include both the singular and the plural. Conversely, any reference to plural elements shall, where appropriate, include the singular.

It is intended that the scope of the disclosure not be limited by the specification but be defined by the claims set forth below. In addition, although narrow claims may be presented below, it should be recognized that the scope of this disclosure is much broader than presented by the claim(s). It is intended that broader claims will be submitted in one or more applications that claim the benefit of priority from this application. Insofar as the description above and the accompanying drawings disclose additional subject matter that is not within the scope of the claim or claims below, the additional disclosures are not dedicated to the public and the right to file one or more applications to claim such additional disclosures is reserved.

What is claimed is:

1. A dish stacking and holding system comprising at plurality of dish stands comprising at least a first dish stand and a second dish stand;

a plurality of dishes, the dishes comprising at least a supporting dish and a supported dish for each dish stand;

each dish stand comprising:

a ring, the ring circumscribing a ring opening;

a plurality of legs connected to and extending downwardly from the ring;

an upward-facing, horizontal ledge connected to the ring and overlapping a horizontal planar area comprised in the ring opening;

the ledge being disposed below a top side of the ring;

the supporting dish comprising a generally flat, horizontal floor surface and an upturned inner sidewall surface, the supporting dish inner sidewall surface being joined to the supporting dish floor surface at a perimeter of the supporting dish floor surface;

each dish stand being operative to be supported on the floor surface of the corresponding supporting dish while the corresponding supported dish is supported on the dish stand;

the ring of each dish stand being operative to receive an inserted portion of a bottom side of the supported dish inserted downwardly into the ring opening so that the inserted dish portion contacts the ledge when the supported dish is supported on the dish stand, the ring being operative to fit around a perimeter of the inserted dish portion so as to obstruct the inserted dish portion from sliding horizontally off of the ledge and so as to retain the supported dish in an aligned horizontal position relative to the ring;

the plurality of legs of each dish stand having a corresponding plurality of flat, horizontal lower ends, the leg lower ends being adapted and configured to be placed simultaneously flush on the supporting dish floor surface when the dish stand is supported on the supporting dish, the leg lower ends aligning with the supporting dish floor surface perimeter so that the dish stand is retained in an aligned horizontal position relative to the supporting dish, and when the supported dish is supported on the dish stand that is so supported on the supporting dish, the supported dish is retained in an aligned horizontal position relative to the supported dish;

said plurality of dishes comprising at least three dishes, a first one of the dishes being the supporting dish of the first dish stand, a second one of the dishes being both the supported dish of the first dish stand and the supporting dish of the second dish stand, and a third one of the dishes being the supported dish of the second dish stand, further comprising:

when the first dish stand is supported on the first dish, the second dish is supported on first dish stand, the second dish stand is supported on the second dish, and the third dish is supported on the second dish stand, an outer perimeter of the second dish is disposed horizontally within an outer perimeter of the first dish, and an outer perimeter of the third dish is disposed horizontally within an outer perimeter of the second dish, the first dish outer perimeter being larger than the second dish outer perimeter, the second dish outer perimeter being larger than the third dish outer perimeter.

2. The dish stacking and holding system of claim 1 wherein the ledge is formed at an upper end of one of the legs.

3. The dish stacking and holding system of claim 2, further comprising a second ledge formed at an upper end of a second one of the legs, the second ledge being connected to the ring and overlapping a second planar area comprised in the opening.

4. The dish stacking and holding system of claim 2 wherein the planar area overlapped by the ledge is equal to at least 30% of a cross-sectional area of the corresponding leg.

5. The dish stacking and holding system of claim 2 wherein the opening has a diameter and a radius, the ledge radially overlapping the opening by a radial intrusion distance, the radial intrusion distance being equal to at least 15% of the diameter of the opening.

6. The dish stacking and holding system of claim 1 wherein each of the legs comprises a corresponding ledge formed at an upper end of the corresponding leg, each of the corresponding ledges being connected to the ring and overlapping a corresponding planar area comprised in the opening.

7. The dish stacking and holding system of claim 1 wherein the ring has a ring axis, the supported dish has a supported dish axis, and the supported dish in the aligned horizontal position is coaxial with the ring.

8. The dish stacking and holding system of claim 1, further comprising the first dish including a first dish rim, the second dish including a second dish rim, and the third dish including a third dish rim, each of the first, second and third dish rims comprising the outer perimeter of the corresponding dish, wherein when the first dish stand is supported on the first dish, the second dish is supported on first dish stand, the second dish stand is supported on the second dish, and the third dish is supported on the second dish stand, the first, second, and third dish rims are positioned so as to share a common tangent line in a vertical plane.

9. A dish stacking and holding system comprising: a dish stand and a supporting dish;

the dish stand comprising a ring, the ring having a bottom side, a pair of notches being formed in the ring bottom side;

a plurality of legs connected to and extending downwardly from the ring;

a horizontal ledge connected to the ring and overlapping an area circumscribed by the ring;

the supporting dish comprising a horizontal floor surface, an upturned inner sidewall surface joined to the supporting dish floor surface and extending around a perimeter of the supporting dish floor surface, and a divider wall, the divider wall extending across the supporting dish floor surface from a first location on the inner sidewall surface to a second location on the inner sidewall surface;

the dish stand being operative to be supported on the supporting dish when the legs are placed on the supporting dish floor surface;

the notches being operative to receive the supporting dish divider wall when the dish stand is supported on the supporting dish;

the dish stand being operative to support a supported dish placed on the horizontal ledge when the dish stand is supported on the supporting dish.

10. The dish stacking and holding system of claim 9 wherein the divider wall extends in along a straight horizontal path, the notches being formed so that, when the supporting dish divider wall is received by the notches, the dish stand is restrained from moving perpendicularly to the horizontal path of the divider wall.

11. The dish stacking and holding system of claim 10 wherein the notches are formed so as to allow the dish stand to move in a horizontal direction along the horizontal path of the divider wall when the divider wall is received by the notches, and the legs are positioned so that, when the dish stand is supported on the supporting dish in a first position in which the dish sidewall contacts at least one of the legs, the dish sidewall is spaced from the legs by a clearance distance in the horizontal direction so that the dish stand is free to move in the horizontal direction by the clearance distance from the first position to a second position in which the dish sidewall contacts at least one of the legs.

12. The dish stacking and holding system of claim 11 wherein, in the first position, the dish sidewall contacts at least a first one of the legs, and in the second position, the dish sidewall contacts at least a second one of the legs different from the first one of the legs.

* * * * *